US006454014B2

(12) United States Patent
Coats et al.

(10) Patent No.: US 6,454,014 B2
(45) **Date of Patent: *Sep. 24, 2002**

(54) METHOD AND APPARATUS FOR A MULTI-STRING COMPOSITE COILED TUBING SYSTEM

(75) Inventors: E. Alan Coats, The Woodlands; Martin D. Paulk, Houston, both of TX (US)

(73) Assignee: Halliburton Energy Services, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/501,913

(22) Filed: Feb. 10, 2000

(51) Int. Cl.[7] ..... E21B 19/00; E21B 19/08; E21B 19/22; B65G 1/127

(52) U.S. Cl. ..... 166/384; 166/77.2; 166/380; 242/167; 242/388.6

(58) Field of Search ..... 166/77.1, 77.2, 166/380, 384; 198/801.6; 242/167, 388.7, 388.8, 559.3, 388.6

(56) References Cited

U.S. PATENT DOCUMENTS

| | | | | |
|---|---|---|---|---|
| 1,307,526 A | | 6/1919 | Tuttle | |
| 2,058,150 A | | 10/1936 | Hayward et al. | |
| 3,559,905 A | | 2/1971 | Palynchuk | 242/52 |
| 3,841,407 A | * | 10/1974 | Bozeman | 166/315 |
| 4,063,691 A | | 12/1977 | Bacvarov | 242/54 R |
| 4,148,445 A | * | 4/1979 | Reynolds et al. | 242/86.5 |
| 4,213,724 A | * | 7/1980 | Holderness | 414/133 |
| 4,454,999 A | * | 6/1984 | Woodruff | 242/86.5 |
| 4,463,814 A | | 8/1984 | Horstmeyer et al. | 175/45 |
| 4,649,954 A | * | 3/1987 | Dunwoody | 137/355.17 |
| 4,895,316 A | | 1/1990 | Salloum | 242/71.8 |
| 5,242,129 A | | 9/1993 | Bailey et al. | 242/115 |
| 5,285,204 A | | 2/1994 | Sas-Jaworsky | 340/854.9 |
| 5,289,845 A | * | 3/1994 | Sipos et al. | 137/355.27 |
| 5,469,916 A | * | 11/1995 | Sas-Jaworsky et al. | 166/64 |
| 5,605,305 A | | 2/1997 | Picton | 242/608 |
| 5,735,482 A | | 4/1998 | Kuzik | 242/537 |
| 5,738,173 A | * | 4/1998 | Burge et al. | 166/385 |
| 5,823,267 A | | 10/1998 | Burge et al. | 166/385 |
| 5,839,514 A | | 11/1998 | Gipson | 166/384 |
| 5,865,392 A | | 2/1999 | Blount et al. | 242/597.2 |
| 5,908,049 A | | 6/1999 | Williams et al. | 138/125 |
| 5,913,337 A | | 6/1999 | Williams et al. | 138/125 |
| 5,988,702 A | | 11/1999 | Sas-Jaworsky | 285/249 |
| 6,065,540 A | | 5/2000 | Thomeer et al. | 166/297 |

FOREIGN PATENT DOCUMENTS

| | | | |
|---|---|---|---|
| EP | 00911 483 A2 | 4/1999 | E21B/17/20 |

OTHER PUBLICATIONS

Alexander Sdas–Jaworsky et al, "Development of Composite Coiled Tubing for Oilfield Services", SPE 26536, 1–15, (1993).

* cited by examiner

*Primary Examiner*—David Bagnell
*Assistant Examiner*—Jennifer M. Hawkins
(74) *Attorney, Agent, or Firm*—Conley, Rose & Tayon, P.C.

(57) ABSTRACT

A reel assembly having three reels disposed side-by-side on a shaft pays out coiled tubing to an injector. A conveyor is used to support and guide the coiled tubing during travel from the reels to the injector. The conveyor is selectively rotatable such that the conveyor may be directed to the reel which actively pays out the coiled tubing. In another embodiment, two reels are slidably disposed side-by-side on a shaft. A conveyor is used to support and guide the coiled tubing during travel from the reels to the injector. In this embodiment, the conveyor is directed to a specific location on the shaft and the reels are slid into the specific location for coiled tubing payout.

18 Claims, 6 Drawing Sheets

METHOD AND APPARATUS FOR A MULTI-STRING COMPOSITE COILED TUBING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

1. Field of the Invention

The present invention relates to devices for handling coiled tubing. More particularly, the present invention relates to coiled tubing handling devices that hold at least two reels of coiled tubing. Still more particularly, the present invention relates to coiled tubing handling systems that use a conveyor to direct coiled tubing to and from at least two reels.

2. Description of the Related Art

Coiled tubing, as currently deployed in the oil field industry, generally includes small diameter cylindrical tubing having a relatively thin wall made of metal or composite material. Coiled tubing is typically much more flexible and of lighter weight than conventional drill pipe. These characteristics of coiled tubing have led to its use in various well operations. For example, coiled tubing is routinely utilized to inject gas or other fluids into the well bore, inflate or activate bridges and packers, transport well logging tools downhole, perform remedial cementing and clean-out operations in the well bore, and to deliver or retrieve drilling tools downhole. The flexible, lightweight nature of coiled tubing makes it particularly useful in deviated well bores.

Typically, coiled tubing is introduced into the oil or gas well bore through wellhead control equipment. A conventional handling system for coiled tubing can include a reel assembly, a gooseneck, and a tubing injector head. The reel assembly includes a rotating reel for storing coiled tubing, a cradle for supporting the reel, a drive motor, and a rotary coupling. During operation, the tubing injector head draws coiled tubing stored on the reel and injects the coiled tubing into a wellhead. The drive motor rotates the reel to pay out the coiled tubing and the gooseneck directs the coil tubing into the injector head. Often, fluids are pumped through the coiled tubing during operations. A rotary coupling provides an interface between the reel assembly and a fluid line from a pump. Such arrangements and equipment for coiled tubing are well known in the art.

While prior art coiled tubing handling systems are satisfactory for coiled tubing made of metals such as steel, these systems do not accommodate the relatively long spans of drill or working strings achievable with coiled tubing made of composites. Such extended spans of composite coiled tubing strings are possible because composite coiled tubing is significantly lighter than steel coiled tubing. In fact, composite coiled tubing can be manufactured to have neutral buoyancy in drilling mud. With composite coiled tubing effectively floating in the drilling mud, downhole tools, such as tractors, need only overcome frictional forces in order to tow the composite coiled tubing through a well bore. This characteristic of composites markedly increases the operational reach of composite coiled tubing. Thus, composite coiled tubing may well allow well completions to depths of 20,000 feet or more, depths previously not easily achieved by other methods.

Moreover, composites are highly resistant to fatigue failure caused by "bending events," a mode of failure that is often a concern with steel coiled tubing. At least three bending events may occur before newly manufactured coiled tubing enters a well bore: unbending when the coiled tubing is first unspooled from the reel, bending when travelling over a gooseneck, and unbending upon entry into an injector. Such accumulation of bending events can seriously undermine the integrity of steel coiled tubing and pose a threat to personnel and rig operations. Accordingly, steel coiled tubing is usually retired from service after only a few trips into a well bore. However, composite coiled tubing is largely unaffected by such bending events and can remain in service for a much longer period of time.

Hence, systems utilizing composite coiled tubing can be safely and cost-effectively used to drill and explore deeper and longer oil wells than previously possible with conventional drilling systems. Moreover, completed but unproductive wells may be reworked to improve hydrocarbon recovery. Thus, composite coiled tubing systems can allow drilling operations into territories that have been inaccessible in the past and thereby further maximize recovery of fossil fuels.

However, these dramatic improvements in drilling operations cannot be realized without handling systems that can efficiently and cost-effectively deploy extended lengths of composite coiled tubing. Prior art coiled tubing handling systems do not readily accommodate the frequent reel change-outs needed when injecting thousands of feet of coiled tubing downhole. Prior art coiled tubing handling systems require a work stoppage to change out an empty reel for a full reel. Because such a procedure is inefficient, there is a need for a coiled tubing handling system that more efficiently changes-out successive reels of coiled tubing.

SUMMARY OF THE PRESENT INVENTION

The present invention overcomes the aforementioned deficiencies of the prior art by providing a system that utilizes multiple reel assemblies that provide enhanced operational efficiencies with respect to prior art reel assemblies. A multiple reel assembly made in accordance with the present invention includes a coaxial arrangement of multiple reels arranged side-by-side on a common platform. In such an arrangement, coiled tubing can be injected from two or more reels successfully without requiring a work stoppage for a reel change-out. A conveyor is used to direct coiled tubing from the reels to a gooseneck or injector head. In one embodiment, a spent reel is slid axially and replaced by a fresh reel. In this embodiment, the conveyor remains generally stationary. In another embodiment, the reels remain generally stationary and the conveyor pivots to accommodate the changing direction of the travel of the coiled tubing. Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
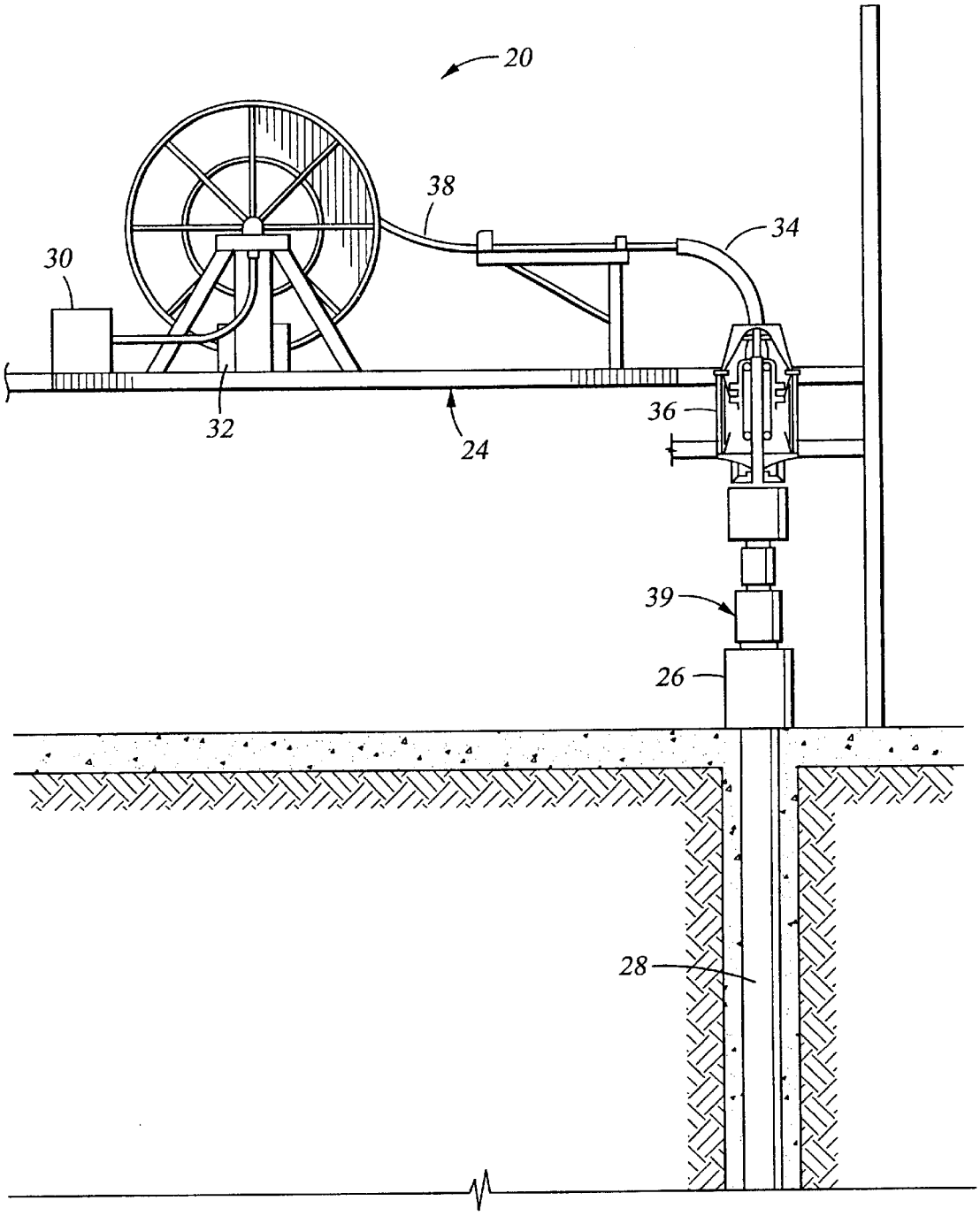
FIG. 1 is a side view of an embodiment of the present invention.

While the advantages of the present invention may be applied to many situations, embodiments of the present invention will be discussed with the respect to oil and gas recovery applications. Referring initially to FIG. 1, an embodiment of a multi-reel system 20 is shown mounted on a rig deck 24 disposed over a wellhead 26 and a wellbore 28. Rig deck 24 may be part of a drilling rig based on land or, alternatively, part of the drilling ship or offshore platform. Further, wellhead 26 and wellbore 28 may be a newly constructed well or an existing structure requiring work-over operations. Multi-reel system 20 is deployed in conjunction with a hydraulic drive 30, a mud pump 32, a gooseneck 34 and an injector 36. Gooseneck 34 funnels coiled tubing 38 from the multi-reel system 20 into injector 36. During the unspooling process, coiled tubing 38 is drawn out and threaded into injector 36, which forces coiled tubing 38 through a blowout preventer stack 39 and ultimately into wellbore 28. Hydraulic drive 30 provides the motive rotational force used by multi-reel system 20 during the spooling and unspooling process. Mud pump 32 can be used to pump drilling fluids such as drilling mud through coiled tubing 38 and ultimately into wellbore 28. Ancillary devices such as level-winds, cranes, friction wheel counters, and power sources are not shown for simplicity. Further, arrangements for introducing coiled tubing into a wellbore are well known in the art and will not be discussed in detail hereinafter.

For purposes of this discussion, "spool" or "spooling" refers to the process of rotating a reel to draw in coiled tubing 38. A "winding" or "windings" refers to a length of coiled tubing that has been disposed on a reel by rotation of the reel. Additionally, composite coiled tubing, as well as arrangements for handling coiled tubing made of composites, are discussed in U.S. application Ser. No. 09/081,961, titled "Well System," filed May 20, 1998, which is hereby incorporated by reference. It should be understood that "tubing" or "coiled tubing" as used in this discussion refers to tubulars made of composites, Fiberglas™, or other materials that are flexible, light-weight, and adapted to oil and gas related applications.

Figure 2:
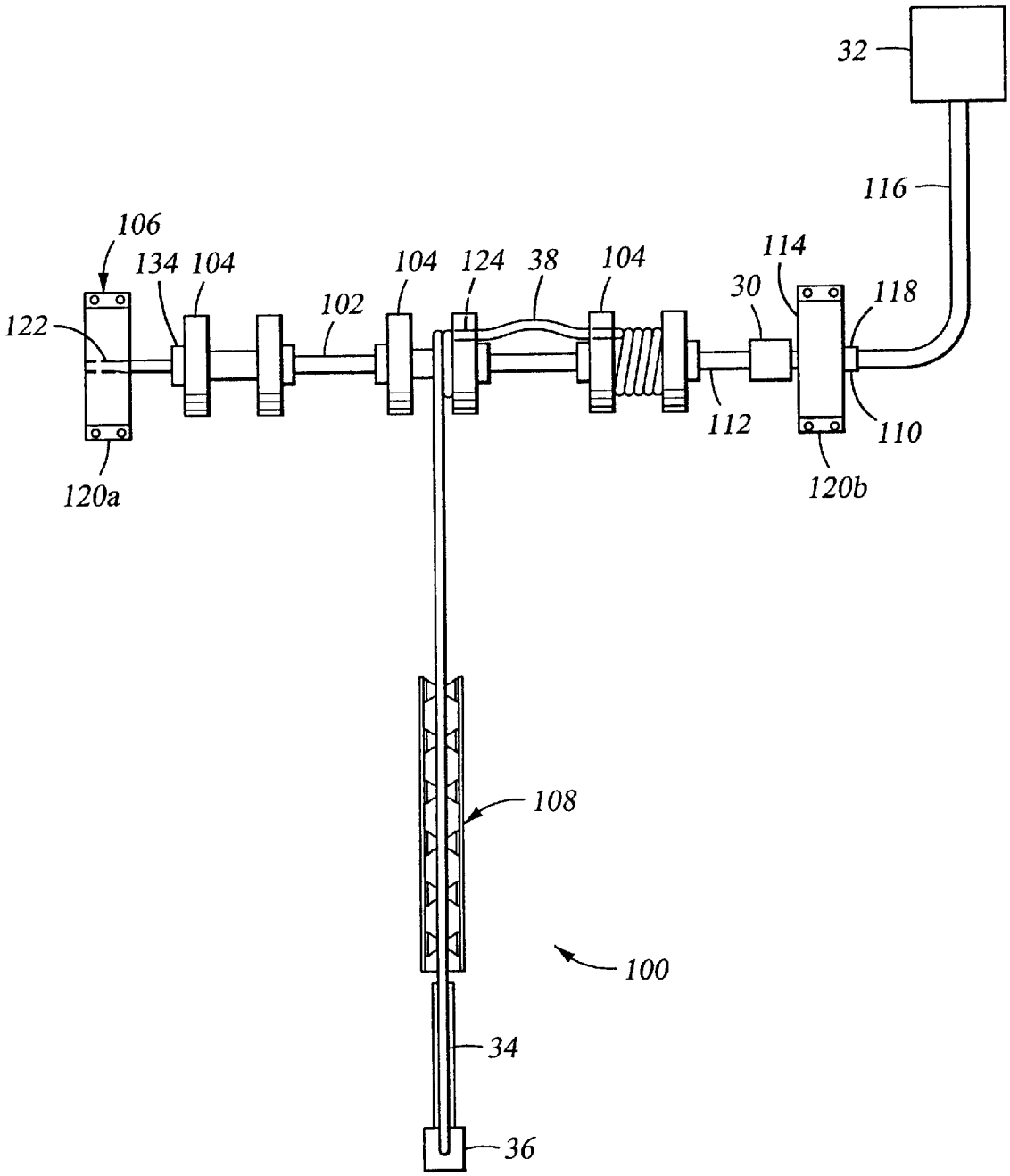
FIG. 2 is a plan view of a first preferred embodiment of the present invention.

Referring now to FIG. 2, a first preferred multi-reel system 100 includes a shaft 102, a plurality of reels 104, a base 106 and a conveyor 108. Shaft 102 supports reels 104 and rotates reels 104 when actuated by hydraulic drive 30. Preferably, shaft 102 includes a bore (not shown) having an inlet port 110 and an outlet port 112. Inlet port 110 is positioned at a first end 114 of shaft 102 and is adapted to receive a fluid line 116 extending from mud pump 32. Outlet port 112 is positioned close to first end 114 of shaft 102 and is configured to allow fluid communication between with the shaft bore and coiling tubing 38 spooled on reels 104. Under normal operations, shaft 102 is rotated by drive 30 and mud pump 32 pumps drilling fluid at elevated hydraulic pressure through coiled tubing 38. Therefore, the interface between inlet port 110 and fluid line 116 preferably includes a rotary coupling 118 adapted to maintain a fluid tight seal during rotation. Such designs are well known in the art. Shaft 102 preferably further includes journal surfaces (not shown) that slidably engage base 106. Shaft 102 is also operatively connected to hydraulic drive 30. Depending on the particular hydraulic drive used, shaft 102 may include geared teeth, a flat or key machined onto shaft 102 or other suitable interface with hydraulic drive 30. While shaft driven reels are prevalent, other reels drives may also be used to support and rotate reels 104. For example, U.S. Pat. No. 4,945,938, which hereby incorporated by reference, discloses a drive system that rotates reels via an engagement with the reel's flanges. Thus, it will be understood that the shaft drive described is merely an illustrative means of supporting and rotating reels 104 and the present invention is not limited to embodiments incorporating shafts.

Base 106 includes a pair of supports 120*a,b*. Preferably, supports 120*a,b* are mounted in a parallel fashion on the rig deck, or platform (not shown), and are sized to carry at least the combined weight of shaft 102, reels 104 and associated coiled tubing 38. Supports 120*a,b* include axially aligned bores 122 having surfaces formed to seat journal surfaces of shaft 102. One or both of supports 120*a,b* disengage from shaft 102 in order to slide reels 104 onto shaft 102. For example, support 120*a* (FIG. 5) may have a hinged lower portion 501 (FIG. 5) or may be fully detachable from the platform. When one or more supports 120*a,b* are disengaged from shaft 102, one or more temporary stands 502 (FIG. 5) may be provided to hold shaft 102. A third support (not shown) may be added in the event that the combined weight of shaft 102, reels 104 and coiled tubing 38 is more than can be safely handled by two supports 120*a,b*. Elements such as bearings, seals, and lubricants are provided as necessary to allow efficient rotation of shaft 102 on supports 120*a,b*.

Reels 104 provide a convenient method of storing coiled tubing 38 in layered helical windings. Preferably, first, second and third reels are disposed axially along shaft 102. To facilitate the interconnection of lengths of coiled tubing 38 spooled on the separate reels 104, reels 104 preferably include slots 124 or conduits through which an end of coiled tubing 38 may pass. Reels 104 are affixed to shaft 102 such that rotation of the shaft 102 causes rotation of the reels 104. A mechanical interface between shaft 102 and reels 104 may be accomplished by any suitable means. For example, shaft 102 may include one or more flats (not shown) that mate with corresponding flats machined in a bore through reel 104. Alternatively, shaft 102 may include a key that is received into a slot machined in the bore. In addition, reels 104 may be held in the proper axial location along shaft 102 by the use of stops or collars 134. The general construction of reels 104 is well known in the art and will not be discussed in detail.

Figure 3:
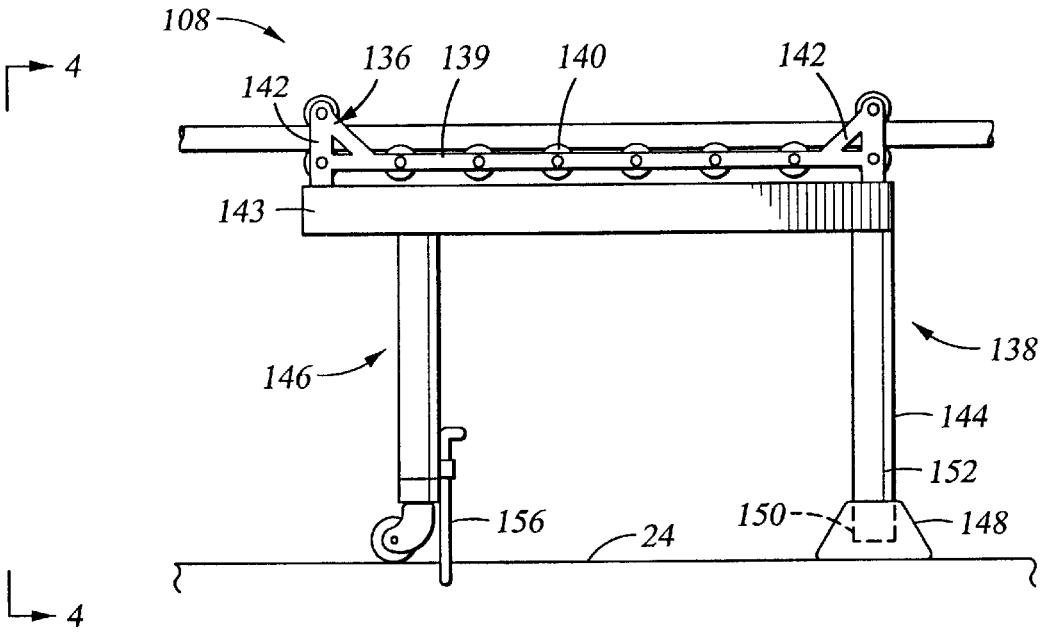
FIG. 3 is a side view of an embodiment of a conveyor used with the first preferred embodiment of the present invention.

Referring still to FIG. 2, conveyor 108 directs coil tubing 38 from reels 104 to the gooseneck 34 and injector 36. Referring now to FIG. 3, conveyor 108 includes a track 136 and a frame 138. Preferably, track 136 includes a cage 139 and a plurality of rollers 140. Preferably, pairs of stacked rollers 142 are provided at the entry and exit points of cage 139. Additional stacked pairs of rollers 142 may be provided along the intermediate portion between the entry and exit of cage 138 to prevent undesired movement of the coiled tubing 38 as it travels from reels 104 to gooseneck 34 (FIG. 2) and injector 36 (FIG. 2). Rollers 140 are elongated cylindrical members rotatably mounted onto cage 139. Rollers 140 may include an arcuate surface generally conforming to the circular cross-sectional profile of composite coiled tubing 38. Typically, the rotation of reels 104 and the injection force provided by injector 36 will provide adequate force to move coiled tubing 38. Accordingly, rollers 140 are not powered and simply rotate as coiled tubing 38 travels over rollers 140. If, however, additional force is required to transport coiled tubing 38, rollers 140 may be provided with a motive force such as an electric motor (not shown) or the like, to actively rotate the rollers 140 and facilitate the movement of coiled tubing 38. It will be understood that there are many variations that may be equally suited for track 136. For example, track 136 may comprise a gutter having a lubricated surface or a surface coated with a slip-enhancing material such as Teflon.

Frame 138 provides vertical support for track 136 and also allows for angular realignment for track 136. Frame includes a beam 143, a post 144, a forward support 146 and a pivot plate 148. Pivot plate 148 is securely mounted onto rig deck 24 and includes a counterbore 150 sized to receive post 144. Preferably, post 144 is an elongated member having a bottom end 152 that pivotably engages pivot plate counterbore 150.

Figure 4:
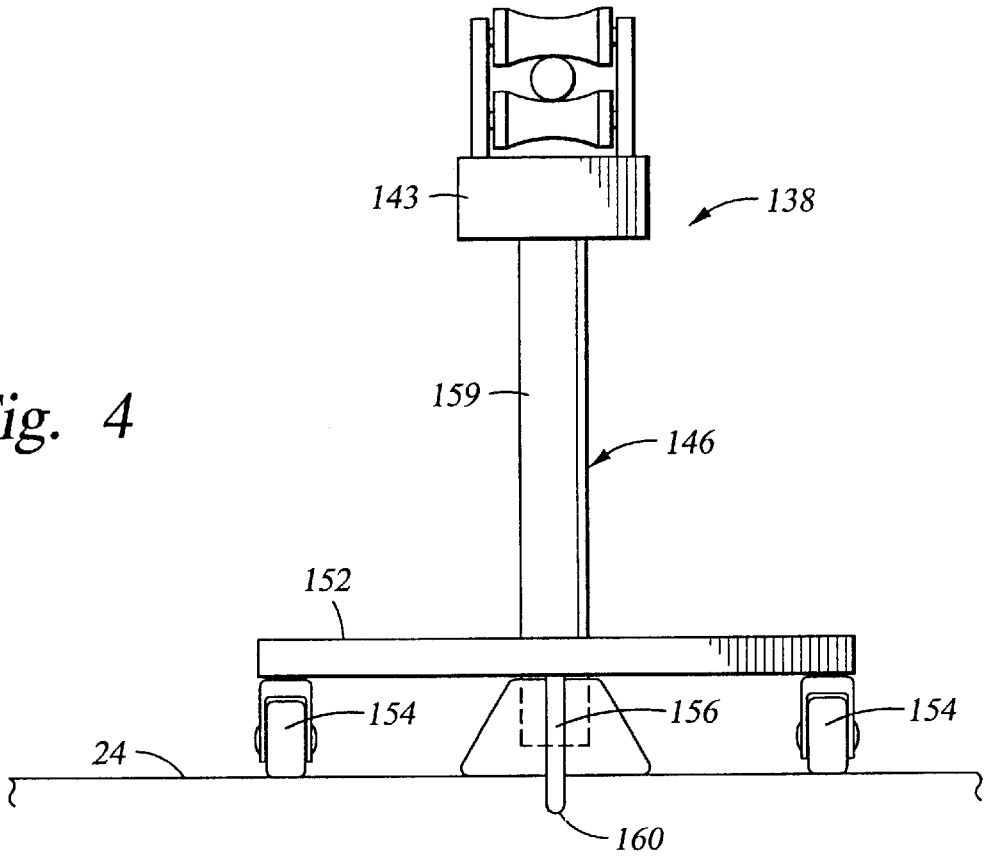
FIG. 4 is an end view of an embodiment of a conveyor used with the first preferred embodiment of the present invention.

Referring now to FIG. 4, a preferred embodiment of forward support 146 includes two wheels 154, a lockrod 156, a crossbar 158 and a vertical beam 159. Vertical beam 159 is mounted in a downwardly vertical fashion from beam 143. Crossbar 158 is securely connected to vertical beam 159. Wheels 154, or casters or other suitable movable load-bearng devices, are preferably disposed on opposite ends of crossbar 158.

Referring now to FIGS. 3 and 4, lockrod 156 is slidably latched to vertical beam 159. Lockrod 156 preferably engages one of several holes 160 on rig deck 24. Alternatively, lockrod 156 may engage a counterbore in a plate (not shown) secured on rig deck 24. Thus, as conveyor 108 rotates about pivot plate 148, it can be locked into a desired angular position by engagement of lockrod 156. Referring now to FIG. 2 and 3, the construction of conveyor 108 is amenable to numerous alternatives that permit track 136 to guide coiled tubing 38 from the reels 104 to the injector head 36. For example, beam 143 may be adapted to pivot about a stationary post 144, thereby eliminating the pivot plate 148. Alternatively, track 136 may pivotably engage beam 143, thereby further eliminating the need for the forward support 146 to have wheels 155.

The distance between the reels 104 and the gooseneck 34 and injector 36 will dictate the actual design of track 136. If the distance is substantial, then track 136 may have to incorporate features that support and actively convey composite coiled tubing 38 from reels 104 to injector 36. On the other hand, if this distance is relatively small, then track 136 may simply need to provide a limited amount of guidance in order to feed coiled tubing 38 from reels 104 to gooseneck 34 and injector 36. Indeed, if reels 104 are sufficiently close to gooseneck 34 and injector 36, then the track 136 may be eliminated. Alternatively, the conveyor may be eliminated by having gooseneck 34 and injector 36 mounted on a rotatable table (not shown). A gooseneck and injector having a rotatable table or platform can be rotated the necessary amount to receive the coiled tubing from the reels in a substantially straight fashion.

Figure 5:
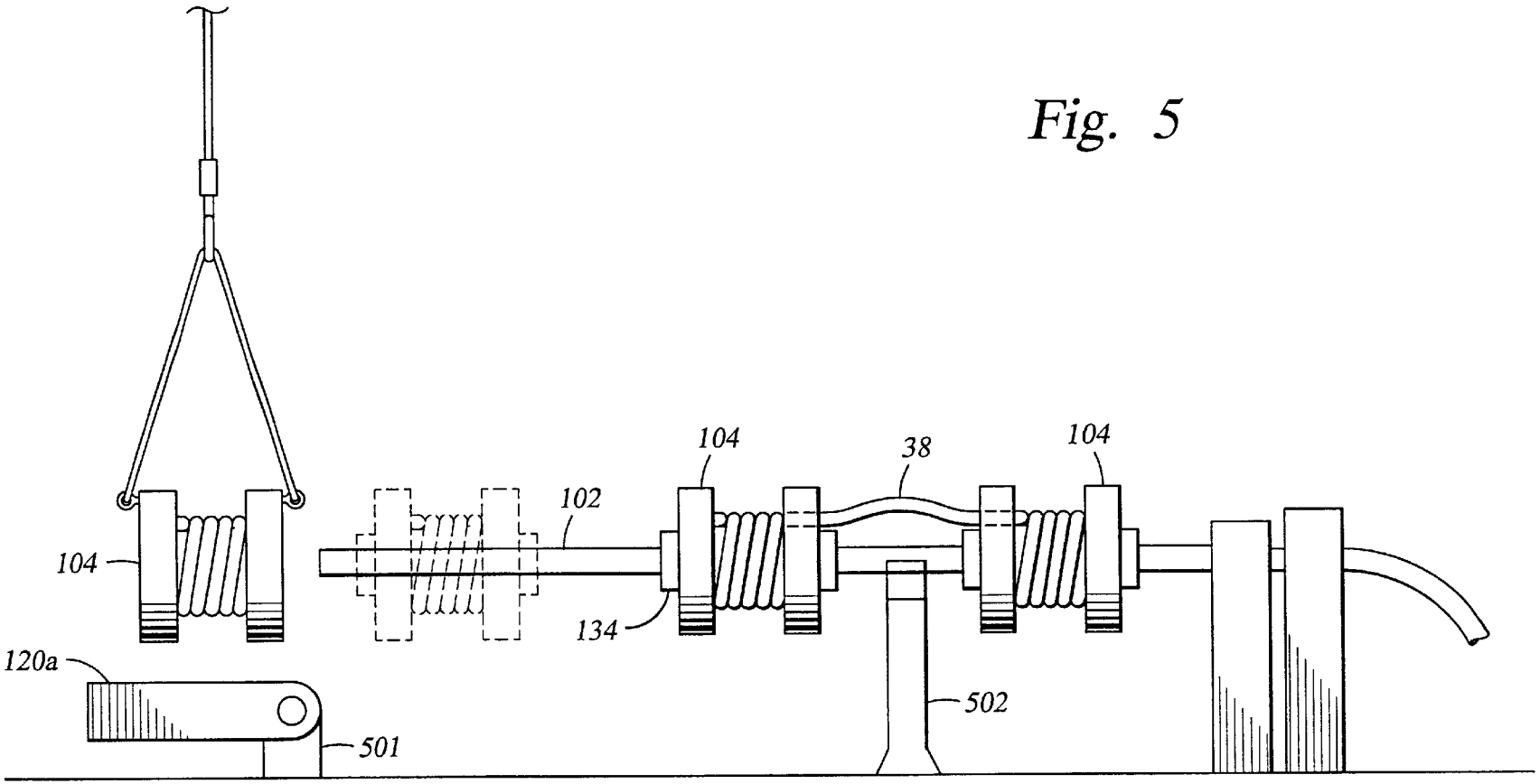
FIG. 5 is a side elevation showing an exemplary loading of reels onto a first preferred embodiment of the present invention.

Referring now to FIG. 5, three full reels 104 are shown being loaded onto shaft 102 in preparation for composite coiled tubing deployment. One or more stands 502 are used to prop up shaft 102 prior to removing one base support 120*a*. The reels 104 are incrementally slid onto the cantilevered end of the shaft 102. Of course, stand 502 may have to be shifted during this process. Once the reels 104 are placed in the desired axial locations, collars 134 are installed to hold reels 104 in place. Thereafter, the coiled tubing connections between reels are made up and preinspection activities may begin.

Figure 6:
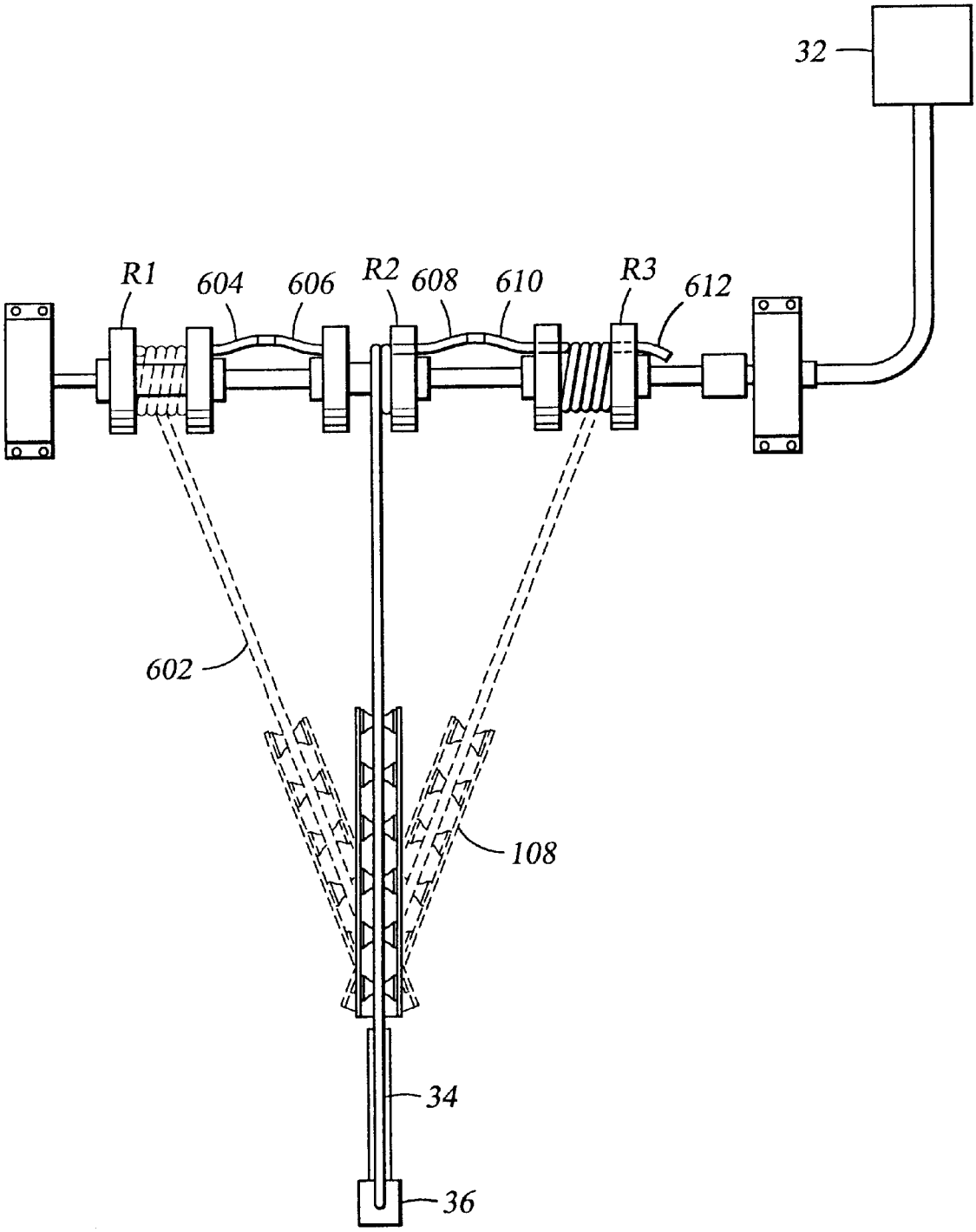
FIG. 6 is an exemplary deployment of coiled tubing by a first preferred embodiment of the present invention.

Referring now to FIG. 6, during operation, the coiled tubing on a first reel R1 has a first end 602 that is threaded through conveyor 108 over the gooseneck 34 and into injector 36. The coiled tubing on first reel R1 has a second end 604 that connects with a first end 606 of the coiled tubing spooled onto second reel R2. Similarly, a second end 608 of the coiled tubing on second reel R2 connects with a first end 610 of the composite coiled tubing stored on a third reel R3. A second end 612 of the composite coiled tubing stored on third reel R3 is connected to the outlet port 112 on shaft 102. Thus, the drilling mud pressurized by mud pump 32 is transported through shaft 102, through the composite coiled tubing on the first, second and third reels and into the well bore. After all the connections on the composite coiled tubing have been made up, injection of the coiled tubing into the well bore can begin.

Figure 7:
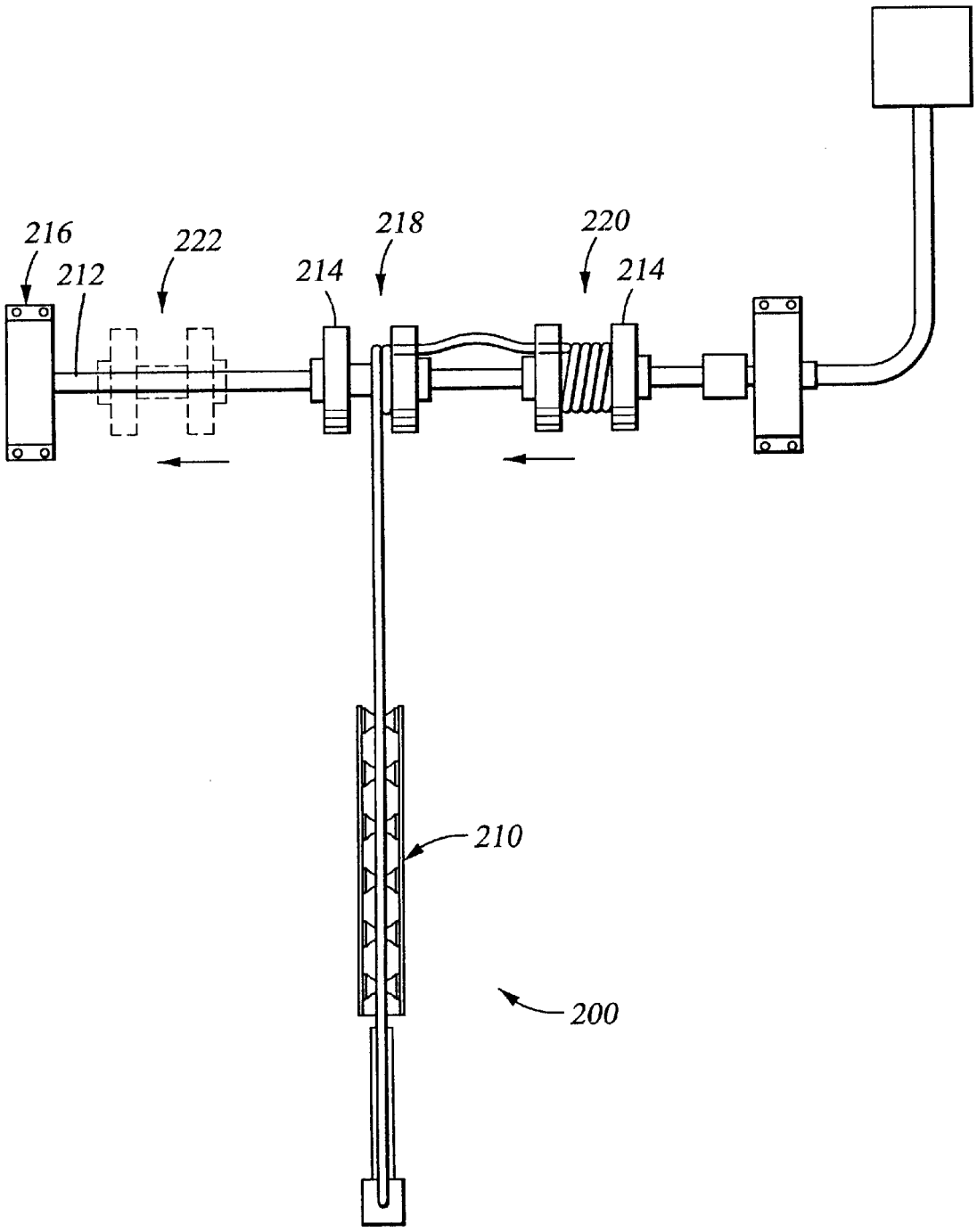
FIG. 7 is a plan view of a second preferred embodiment of the present invention.

Conveyor 108 is initially set in position A. Thus, although the composite coiled tubing on first reel R1 is not in direct alignment with the gooseneck and injector, the use of conveyor 108 provides smooth transition from first reel R1 to the gooseneck. Once the supply of coiled tubing on first reel R1 has been exhausted, conveyor 108 is shifted to position B. Again, the supply of coiled tubing on second reel R2 is injected until second reel R2 is exhausted. Thereafter, the conveyor is set at position C, which is directed towards third reel R3. Thus, it can be seen that an extended length of coiled tubing can be injected into the well bore without intermittent stops to make up the connections between spans of coiled tubing or move reels into position. Referring now to FIG. 7, a second embodiment of a multi-reel system 200 in accordance with the present invention includes a stationary conveyor 210, a shaft 212, reels 214, and a base 216. Conveyor 210 is permanently directed to the center of shaft 212. Shaft 212 includes a center portion 218, a first adjacent portion 220 and second adjacent portion 222. Center portion 218 and first adjacent portion 220 each accommodate one reel 214. Second adjacent portion 222 is sized to accept a reel 214 shifted from center portion 218. Shaft 212 is adapted to allow reels 214 to slide along shaft 212 and thereby be shifted from, for example, center portion 218 to second adjacent portion 220. It will be understood that shaft 212 and reels 214 may already incorporate a sliding mechanism for loading reels 214 on, or unloading reels 214 from, shaft 212. Such a mechanism need only be modified to allow intermittent shifting of reels 214 during the spooling or unspooling operation.

Second multi-reel system 200 is fabricated in generally the same manner as the FIG. 3 embodiment of multi-reel system 100. However, conveyor 210 need not include elements that allow conveyor 210 to pivot. Additionally, because coiled tubing travels along a substantially straight path, conveyor 210 may require fewer supports, such as rollers, to limit undesired movement of the coiled tubing.

For the second multi-reel system, the pre-injection procedures are substantially the same as for the first multi-reel system except that only a center reel and an offset reel are loaded onto the shaft. During the injection process, the conveyor is permanently directed to a specific reel location on the reel platform, such as the center reel. Once the supply of coiled tubing on the center reel has been exhausted, the center reel is shifted to the vacant portion of the shaft and the offset reel is shifted into the center position. It will be understood that the coiled tubing on the offset reel is made up to an outlet port on the shaft. There should be enough slack available in the coil tubing to allow second reel to slide axially into alignment with the conveyor. Thus, it can be seen that an extended length of coiled tubing can be injected into the well bore without intermittent stops to make up the connection between the coiled tubing and the change out reel in a time consuming procedure. It will be understood that the procedure is generally reversed during the process.

While preferred embodiments of this invention have been shown and described, modifications thereof can be made by one skilled in the art without departing from the spirit or teaching of this invention. For example, much of the above discussion involves embodiments of the present invention that include two or three reels. It will be apparent that more than two or three reels may be utilized without departing from the scope of the present invention. Furthermore, the present invention has been described with respect to a conventional reel system that utilizes a solid shaft to support and rotate reels. However, the present invention may be just as easily applied to other reel deployment systems such as the reel assembly disclosed in U.S. Pat. No. 5,289,845, which discusses an improved coiled tubing reel and unit utilizing a system of two non-continuous spindles, and U.S. Pat. No. 4,945,938, which discusses a shaftless system, both of which are hereby incorporated by reference. Moreover, the embodiments of the present invention have been described primarily with respect to the injection process, which involves unspooling the coiled tubing from the reels. However, it should be understood that the descriptions apply also to the spooling operation when the coiled tubing is drawn out of the well bore. Thus, the embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A reel system used with an injector positioned over a wellbore, comprising:

a base;

a shaft rotatably mounted on said base;

first and second reels disposed along said shaft; and a working string formed of composite coiled tubing, a first portion of said working string being spooled on said first reel and a second portion of said working string being spooled on said second reel, wherein said first portion is connected to said second portion before said first portion is completely injected into the wellbore.

2. The reel system of claim 1, further comprising a track having a plurality of rollers, said track being adapted to guide said working string to a pre-determined location.

3. The reel system of claim 2 wherein said track can be disposed in a first position for receiving said working string from said first reel and a second position for receiving said working string from said second reel.

4. A reel system, used with an injector positioned over a wellbore, comprising:

a base;

a shaft rotatably mounted on said base;

first and second reels disposed along said shaft;

a working string formed of composite coiled tubing, a first portion of said working string being spooled on said first reel and a second portion of said working string being spooled on said second reel, wherein a portion of the second reel is connected to a portion of the first reel before the first portion of tubing is injected into the wellbore; and a track having a plurality of rollers, said track being adapted to guide said working string to a pre-determined location, wherein said reels are adapted to slide along said shaft; and said shaft includes an empty section for receiving an emptied reel.

5. The reel system of claim 4, further comprising a third reel disposed along said shaft; wherein said working string further includes a third portion spooled on said third reel, and wherein said track includes a third position for receiving working string from said third reel.

6. The system of claim 5 wherein said track is attached to a frame that is pivotably mounted on a rig deck.

7. A reel system, comprising:

a base;

a shaft rotatably mounted within said base, said shaft having a bore having an inlet port and an outlet port;

a pump in fluid communication with said inlet port;

a first reel disposed on said shaft;

a second reel disposed on said shaft next to said first reel;

a drive motor associated with said shaft, said drive motor providing controlled rotation of said shaft;

a working string formed of composite coiled tubing, said working string having a surface end in fluid communication with said outlet port, a first portion spooled on said first reel, a second portion spooled on said second reel, and a second end, wherein said first portion is connected to said second portion before said first portion is completely injected into the wellbore; and a pivotable track adapted to guide said working string to a predetermined location, said track having a first position for receiving said working string from said first reel and a second position for receiving working string from said second reel, wherein said track is attached to a frame that is pivotably mounted on a rig deck.

8. A reel system, comprising:

a base;

a shaft rotatably mounted within said base, said shaft having a bore having an inlet port and an outlet port;

a pump in fluid communication with said inlet port;

a first reel disposed on said shaft;

a second reel disposed on said shaft next to said first reel;

a drive motor associated with said shaft, said drive motor providing controlled rotation of said shaft, wherein said shaft includes a vacant portion, a center portion and an offset portion, said first reel being disposed within shaft center portion, and said second reel disposed within said shaft offset portion;

a working string formed of composite coiled tubing, said working string having a surface end in fluid communication with said outlet port, a first portion spooled on said first reel, a second portion spooled on said second reel, and a second end, wherein said first portion is connected to said second portion before said first portion is completely injected into the wellbore; and a pivotable track adapted to guide said working string to a pre-determined location, said track having a first position for receiving said working string from said first reel and a second position for receiving working string from said second reel, wherein said track is attached to a frame that is pivotably mounted on a rig deck.

9. A method for injecting a length of coiled tubing into a well, the method comprising:

providing a shaft, a fluid supply and a wellhead;

positioning a first reel in a first position on the shaft, the first reel having a first length of coiled tubing spooled thereon, the first coiled tubing length having a first upstream end and a first downstream end;

positioning a second reel in a second position on the shaft, the second reel having a second length of coiled tubing spooled thereon, the second coiled tubing length having a second upstream end and a second downstream end;

connecting the first upstream end to the fluid supply;

connecting the first downstream end to the second upstream end; and injecting the first and second coiled tubing lengths into the wellhead, wherein said connecting steps are performed before said injecting step.

10. The method according to claim 9, further comprising a track having a plurality of rollers, said track being adapted to guide the first and second coiled tubing lengths to a pre-determined location.

11. The method according to claim 10 wherein the guiding is accomplished by positioning the track in a first angular orientation to direct the first coiled tubing length to the injector; and positioning the track in a second angular orientation to direct the second coiled tubing length to the injector.

12. The method according to claim 9 further comprising:

positioning a third reel in a third position on the shaft, the third reel having a third length of coiled tubing spooled thereon, the third coiled tubing length having a third upstream end and a third downstream end;

connecting the second downstream end to the third upstream end; and injecting the third coiled tubing length into a well, wherein said connecting step is performed before said injecting step.

13. The method according to claim 12, further comprising positioning a track in a first angular orientation to direct the first coiled tubing length to the injector; positioning the track in a second angular orientation to direct the second coiled tubing length to the injector; positioning the track in a third angular orientation to direct the third coiled tubing length to the injector.

14. A method for injecting a length of coiled tubing into a well, the method comprising:

providing a shaft, a fluid supply and a wellhead;

positioning a first reel in a first position on the shaft, the first reel having a first length of coiled tubing spooled thereon, the first coiled tubing length having a first upstream end and a first downstream end;

positioning a second reel in a second position on the shaft, the second reel having a second length of coiled tubing spooled thereon, the second coiled tubing length having a second upstream end and a second downstream end;

connecting the first upstream end to the fluid supply;

connecting the first downstream end to the second upstream end;

injecting the first and second coiled tubing lengths into the wellhead, wherein said connecting steps are performed before said injecting step; and sliding the second reel out of the second position when the second reel is substantially empty of coiled tubing; and sliding the first reel into the second position.

15. A method of deploying coiled tubing into a wellbore, the method comprising:

positioning a first reel beside a second reel the first and second reels supporting first and second lengths of coiled tubing, respectively;

connecting the first coiled tubing length to the second coiled tubing length to form a continuous length of coiled tubing;

rotating the first and second reels so as to supply an injector with a continuous length of coiled tubing; and injecting said tubing into the wellbore using the injector.

16. The method according to claim 15, further comprising:

providing a third reel supporting a third length of coiled tubing; and connecting the third coiled tubing length to the to the second coiled tubing length to form a continuous length of coiled tubing prior to beginning injection.

17. The method according to claim 15 further comprising guiding the coiled tubing from the reels to the injector using a pivoting track.

18. A reel system, comprising:

a base;

a shaft rotatably mounted within said base, said shaft having a bore having an inlet port and an outlet port;

a pump in fluid communication with said inlet port;

a first reel disposed on said shaft;

a second reel disposed on said shaft next to said first reel;

a drive motor associated with said shaft, said drive motor providing controlled rotation of said shaft;

a working string formed of composite coiled tubing, said working string having a surface end in fluid communication with said outlet port, a first portion spooled on said first reel, a second portion spooled on said second reel, and a second end; and a track adapted to guide said working string to a pre-determined location;

wherein said shaft includes a vacant portion, a center portion and an offset portion, said first reel being disposed within shaft center portion, and said second reel disposed within said shaft offset portion.

* * * * *